US006766653B2

(12) United States Patent
Hong

(10) Patent No.: US 6,766,653 B2
(45) Date of Patent: Jul. 27, 2004

(54) METHOD FOR CONTROLLING OPERATION OF A MULTI-AIR CONDITIONER

(75) Inventor: Ki Su Hong, Anyang-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/459,505

(22) Filed: Jun. 12, 2003

(65) Prior Publication Data

US 2003/0230102 A1 Dec. 18, 2003

(30) Foreign Application Priority Data

Jun. 12, 2002 (KR) ..... P10-2002-0032902

(51) Int. Cl.[7] ..... F25B 1/00; F25B 49/00
(52) U.S. Cl. ..... 62/228.3; 62/117
(58) Field of Search ..... 62/228.3, 159, 62/160, 117, 199, 228.4, 228.5, 222

(56) References Cited

U.S. PATENT DOCUMENTS 4,122,686 A * 10/1978 Lindahl et al. ..... 62/81
4,873,837 A * 10/1989 Murray ..... 62/199
4,951,475 A * 8/1990 Alsenz ..... 62/117
5,440,891 A * 8/1995 Hindmon et al. ..... 62/117

* cited by examiner

*Primary Examiner*—Marc Norman
(74) *Attorney, Agent, or Firm*—Greenblum & Bernstein, P.L.C.

(57) ABSTRACT

The present invention discloses a method for operating a multi-air conditioner in which indoor rooms can be air-conditioned above a predetermined level. The method includes the steps of: compressing refrigerant at a compressor provided in an outdoor unit and discharging the compressed refrigerant; measuring, in heating mode or cooling mode, a pressure of the refrigerant in a plurality of indoor heat exchangers side and the compressor side; and compensating for the pressure of the refrigerant in the indoor heat exchangers side in a prescribed pressure range at a control unit.

20 Claims, 3 Drawing Sheets

METHOD FOR CONTROLLING OPERATION OF A MULTI-AIR CONDITIONER

This application claims the benefit of the Korean Application No. P2002-0032902 filed on Jun. 12, 2002, which is hereby incorporated by reference.

BACKGROUND OF THE INVENTION

1. Field of the Invention

The present invention relates to an operational method of a multi-air conditioner, and more particularly, to a method to compensate for refrigerant pressure of an indoor unit.

2. Discussion of the Related Art

Generally, air conditioner is an apparatus to cool/heat indoor space such as a residential space, office, restaurant and the like, and is provided with a compressor and a heat exchanger to flow refrigerant and thus cool/heat indoor air.

The development of the air conditioners is directed toward a multi-air conditioner capable of performing cooling and heating at the same time so as to maintain more pleasant indoor environment without being affected by external temperature and environment. As a result, it became possible to cool or heat an overall room at the same operation mode.

In these multi-air conditioners, a plurality of indoor units are connected to a single outdoor unit. Each indoor unit is installed in each room and is operated in either cooling mode or heating mode to control indoor temperature.

However, as the indoor structure becomes complicated, locations, uses and sizes of respective rooms are different and lengths and diameters of pipes connecting between the outdoor unit and the respective indoor units are also different, there is a limitation in cooling or heating the respective rooms uniformly.

In other words, the refrigerant flowing through an indoor unit arranged to be distant from the outdoor unit relative to other indoor unit(s), has a refrigerant pressure that is lower than the refrigerant pressure of other indoor unit due to a pressure drop. This indicates that the flow amount of the refrigerant is non-uniform, so that the cooling or heating efficiency of the distant indoor unit is lowered compared with other room(s).

SUMMARY OF THE INVENTION

Accordingly, the present invention is directed to a method for controlling an operation of a multi-air conditioner that substantially obviates one or more problems due to limitations and disadvantages of the related art.

An object of the present invention is to provide a method for controlling an operation of a multi-air conditioner in which each room can be sufficiently air-conditioned although lengths and diameters of pipes connecting between an indoor unit and respective outdoor units are different from each other.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method for controlling an operation of a multi-air conditioner. The method includes the steps of: compressing refrigerant by a compressor provided in an outdoor unit and discharging the compressed refrigerant; measuring, in a heating mode or a cooling mode, a pressure of the refrigerant flowing in or out a plurality of indoor heat exchangers and the compressor; and compensating the pressures of the refrigerant in the indoor heat exchangers in a prescribed pressure range.

In more detail, the step of measuring the pressures of the refrigerant flowing in or out the indoor heat exchangers comprises the step of measuring the pressures of the refrigerant in an inlet and outlet of each of the heat exchangers.

The step of compensating for the pressure comprises the steps of: comparing any one of the measured pressures of the refrigerant flowing in or out the indoor heat exchangers with the prescribed pressure and determining which one is greater than the other; and increasing a compressive force of the compressor according to the result of the comparison.

In more detail, the step of comparing pressures comprises the step of comparing the lowest pressure of the refrigerant flowing in or out the indoor heat exchangers or an average pressure of the pressures of the refrigerant flowing in or out the indoor heat exchangers side with the prescribed pressure.

Also, the step of compensating the pressure includes the steps of: comparing any one of differences between the pressures of the refrigerant flowing in or out the indoor heat exchangers and the pressure of the refrigerant flowing in or out the compressor with the prescribed pressure and determining which one is greater than the other; and increasing a compressive force of the compressor according to the result of the comparison.

The step of increasing the compressive force further includes step of gradually increasing the compressive force of the compressor by a variable compressor. Also, the compressor is preferably a variable compressor enabling to increase the compressive force depending on a variation in length or diameter of a connection pipe.

When the variation in load of the multi-air conditioner is large, an operation control method of a multi-air conditioner including a constant-speed compressor together with the variable compressor can be selected to increase the compressive force.

According to the aforementioned operational method of the invention, although lengths and diameters of pipes connecting between the respective indoor units are different, it is possible to sufficiently air-condition the respective rooms.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

To help the understanding of the present invention, functions of a multi-air conditioner will be first described. Air conditioner functions to cool or heat an indoor space such as a residential space, office, restaurant and the like.

In such an air conditioner, in a cooling mode, heat is radiated to outdoor air after a low pressure refrigerant absorbing indoor heat is compressed to a high pressure refrigerant. On the contrary, in the heating mode, inverse operation is performed.

Figure 1:
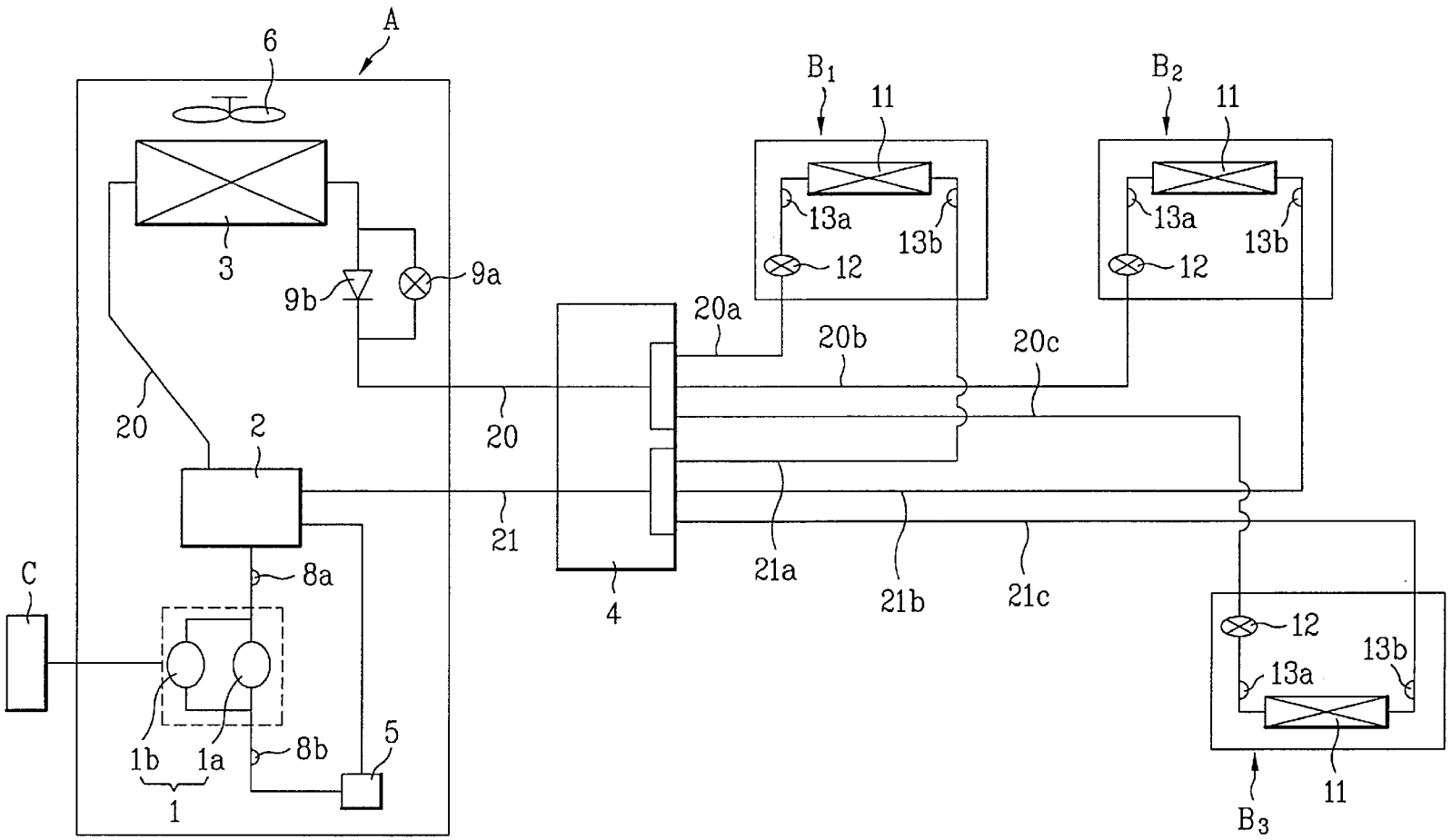
FIG. 1 is a schematic view exemplarily showing a multi-air conditioner operated by a control method of the present invention.

FIG. 1 shows an overall construction of a multi-air conditioner operated by a control method of the present invention.

As shown in FIG. 1, the multi-air conditioner includes an outdoor unit (A) installed at an outdoor site and exchanging heat with the outdoor air, a plurality of indoor units (B: B1, B2, B3) respectively installed at indoor rooms and exchanging heat with indoor air, a pressure control unit (C) which is supplied with pressures of indoor heat exchangers 11 provided in the indoor units (B) and pressure of a compressor 1, for increasing the pressure of the compressor 1 such that each of the pressures of the indoor heat exchangers 11 is held above a predetermined pressure, and connection pipes 20, 21 connecting between the outdoor unit and the respective indoor units.

The outdoor unit (A) functions to compress refrigerant and exchange heat with outdoor air. The outdoor unit (A) includes a compressor for compressing the refrigerant, a flow control unit 2 for controlling the flow of the refrigerant compressed in the compressor depending on an operation condition, an outdoor heat exchanger 3 connected with the flow control unit 2, and a pressure sensor 8 for measuring the pressure of the compressor 1.

The compressor 1 preferably includes a variable compressor 1*a* capable of increasing the compressive force depending on a pressure difference in the indoor heat exchanger 11 due to the length or diameter of the connection pipes. More preferably, the compressor 1 further includes a constant-speed compressor 1*b*.

The indoor unit 1 includes the indoor heat exchangers 11, a cooling mode electronic expansion valve 12 connected with the indoor heat exchangers 11, and a pressure sensor 13 provided on the connection pipe of the indoor heat exchanger, for measuring the refrigerant pressure.

The pressures of the indoor heat exchangers 11 may be measured by a method that the temperature sensed by the temperature sensor is converted into a pressure.

In the meanwhile, the operation mode includes a cooling mode for cooling indoor air and a heating mode for heating indoor air. The flow of the refrigerant discharged from the compressor 1 is controlled by the flow control unit 2. The flow control unit 2 may be realized by 4-way valve.

Reviewing the refrigerant flow in the cooling mode, the refrigerant discharged from the compressor 1 passes through the 4-way valve and is again sucked into the compressor via the outdoor heat exchanger 3, the electronic expansion valve 12 of the indoor unit and the indoor heat exchangers 11 sequentially.

In the meanwhile, in the heating mode, the refrigerant discharged from the compressor 1 is guided into the indoor heat exchanger 11 by the 4-way valve to exchange heat. The refrigerant discharged from the indoor heat exchangers 11 is again sucked into the compressor 1 via the heating mode electronic expansion valve 9*a* of the outdoor unit and the outdoor heat exchanger 3.

Next, the structure of the aforementioned multi-air conditioner and a method for controlling an operation of the multi-air conditioner will be described with reference to the accompanying drawings.

Figure 2:
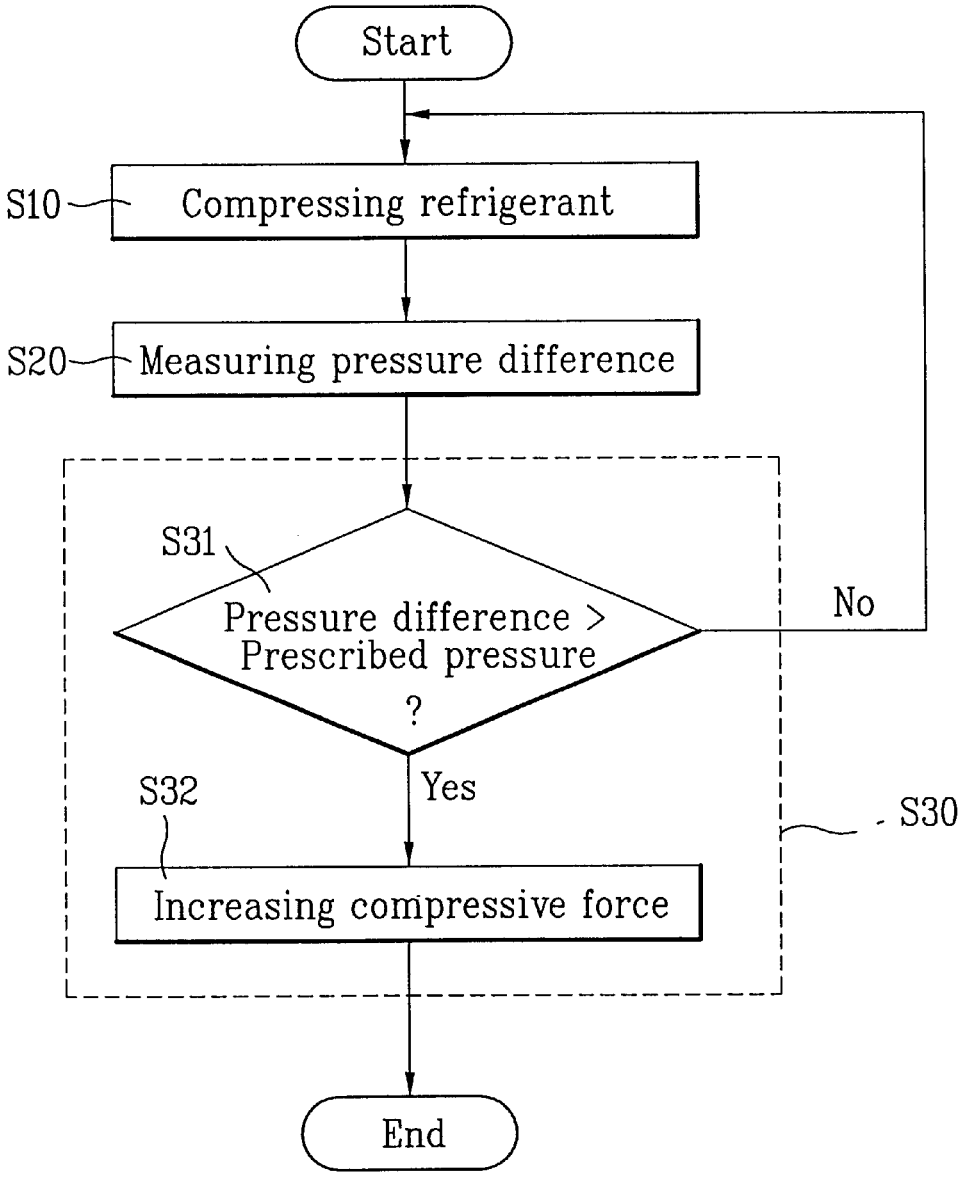
FIG. 2 is a flow chart illustrating an operational method of a multi-air conditioner according to the present invention.
Figure 3:
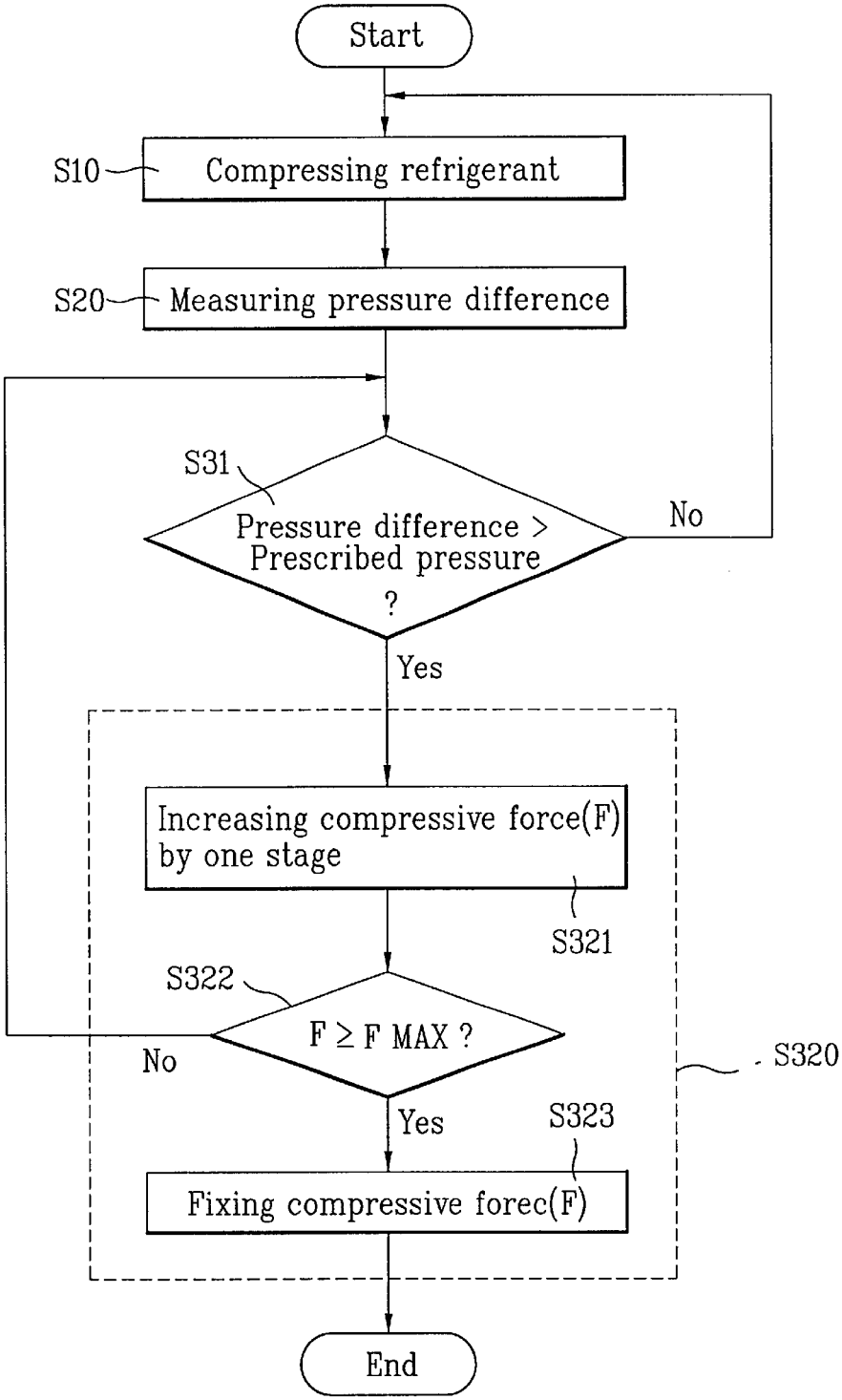
FIG. 3 is a flow chart illustrating an operational method of a multi-air conditioner in which the compressive force is increased at multi-stages.

Referring to FIGS. 1 to 3, the method includes the steps of: (S10) compressing refrigerant by the compressor 1 provided in the outdoor unit (A) and discharging the compressed refrigerant; (S20) measuring, in heating mode or cooling mode, pressures of the refrigerant flowing in or out a plurality of indoor heat exchangers 11 and the compressor 1; and (S30) compensating the pressures of the refrigerant in the indoor heat exchangers 11 in a set pressure range.

Hereinafter, the aforementioned steps will be described in more detail.

First, the compressor 1 provided in the indoor unit (A) compresses a low pressure refrigerant to a high pressure refrigerant and discharges the compressed refrigerant. The discharged refrigerant flows into the indoor heat exchangers 11 via predetermined paths according to the cooling mode or the heating mode as aforementioned.

After the compressing step S10, the pressures of the refrigerant flowing in or out the indoor heat exchangers 11 and the compressor 1 are measured by the pressure sensor provided in the indoor unit and the compressor 1.

In more detail, the pressure in an inlet refrigerant pressure of each of the indoor heat exchangers 11 is measured depending on the operation modes. Here, the pressures of the refrigerant flowing in or out the indoor heat exchangers 11 can be measured by a method that the temperature measured by a temperature sensor is converted to a pressure stored in the temperature sensor.

In the meantime, the step of compensating the pressure includes the steps of: (S31) comparing any one of the measured pressures of the refrigerant flowing in or out the indoor heat exchangers 11 with the prescribed pressure stored and determining which one is greater than the other; and (S32) increasing a compressive force of the compressor according to the result of the comparison.

Herein, comparing pressures is preferably performed on the basis of the lowest pressure of the pressures of the refrigerant flowing in or out the indoor heat exchangers 11, i.e., on the basis of the indoor heat exchanger with the lowest pressure. Alternatively, the step of comparing pressures can be performed by comparing an average pressure of the pressures of the refrigerant flowing in or out the indoor heat exchangers 11 with the prescribed pressure.

Also, the step of comparing the pressures can be performed by comparing any one of differences between the pressures of the refrigerant flowing in or out the indoor heat exchangers 11 and the pressure of the refrigerant flowing in or out the compressor 1 with the set pressure and determining which one is greater than the other. This comparing step will be described in an embodiment described later.

The step (S32) of increasing the compressive force according to the comparing result at the pressure control unit (C) is performed when the measured value is below the prescribed pressure.

Preferably, the step (S32) of increasing the compressive force includes the step (S320) of gradually increasing the compressive force of the compressor. Also, in the step (S32) of increasing the compressive force, the compressor 1 is preferably a variable compressor 1*a* capable of increasing the compressive force depending on a variation in length or diameter of a connection pipe.

More preferably, the compressor 1 is configured to further include a constant-speed compressor 1*b* along with the variable compressor 1*a* to correspond to a variation in the load of the multi-air conditioner.

Hereinafter, there will be described a method for controlling an operation of a multi-air conditioner according to another embodiment of the invention with reference to FIGS. 1, 2 and 3. Since the basic constitution of the multi-air conditioner is the same as that described in the previous embodiment, its description will be omitted hereinafter.

As aforementioned, a basic operational method of a multi-air conditioner includes the steps of: (S10) compressing refrigerant by the compressor 1 provided in the outdoor unit (A) and discharging the compressed refrigerant; (S20) measuring, in the heating mode or the cooling mode, pressures of the refrigerant flowing in or out a plurality of indoor heat exchangers 11 and the compressor 1; and (S30) compensating the pressures of the refrigerant in the indoor heat exchangers 11 in a set pressure range at the pressure control unit.

Preferably, the step (S20) of measuring the pressure includes the steps of: measuring, in the cooling mode, an inlet refrigerant pressure 13*a* of each of the indoor heat exchangers 11 and an inlet refrigerant pressure (suction terminal) 8*b* of the compressor 1 considering flow of the refrigerant.

The reason is why in the cooling mode, the refrigerant flows into the compressor 1 via the indoor heat exchangers 11 and accordingly, measuring the pressure of the refrigerant in the suction terminal 8*b* permits an operator to relatively accurately catch the lowering in the pressure while the phase of the refrigerant in the compressor 1 is held equal to the phase of the refrigerant of the indoor heat exchangers 11. And, since the pressure of the refrigerant in the inlet 13*a* of the indoor heat exchangers 11 is in a less reduced state compared with the pressure in the outlet 13*b*, measuring the pressure of the refrigerant in the inlet 13*a* causes a larger pressure difference than measuring the pressure of the refrigerant in the outlet 13*b*, which allows the operator to measure the pressure difference more easily.

In the heating mode, it is preferable to measure the outlet refrigerant pressure of each of the indoor heat exchangers 11 and the outlet refrigerant pressure (discharge terminal) of the compressor considering flow of the refrigerant.

The reason is why in the heating mode, the refrigerant is discharged from the compressor 1 and flows the indoor heat exchangers 11 and accordingly, measuring the pressure of the refrigerant in the discharge terminal 8*a* permits an operator to relatively accurately catch the lowering in the pressure while the phase of the refrigerant in the compressor 1 is held equal to the phase of the refrigerant of the indoor heat exchangers 11. And, since the pressure of the refrigerant in the outlet 13*a* of the indoor heat exchangers 11 is in a more reduced state compared with the pressure of the refrigerant in the inlet 13*b*, measuring the pressure of the refrigerant in the outlet 13*a* causes a larger pressure difference than measuring the pressure of the refrigerant in the inlet 13*b*, which allows the operator to measure the pressure difference more easily.

After the pressure measurement is completed, data is transmitted to the pressure control unit (C), and the pressure control unit (C) performs the step (S31) of comparing any one of pressure differences between the pressures of the refrigerant of the indoor heat exchangers 11 and the pressure of the refrigerant of the compressor 1 with the set pressure to determine which one is greater than the other one.

The set pressure is inputted in advance depending on the operational condition and stored in the pressure control unit (C). Alternatively, the maximum value of the pressure differences can be compared with the prescribed pressure, or an average value of the pressure differences can be compared with the prescribed pressure. To operate all the rooms of the multi-air conditioner at an efficiency above a constant level, the former method is effective.

As a result of processing the step (S31) of comparing the pressures, the pressure control unit (C) performs the step (S320) of increasing the compressive force of the compressor according to the result of comparison. In more detail, in the step (S320) of increasing the compressive force, if the pressure difference exceeds the prescribed pressure, the compressive force is increased.

Also, in the step (S320) of increasing the compressive force, it is more preferable to gradually increase the compressive force of the compressor l. The compressor 1 is preferably a variable compressor 1*a* capable of increasing the compressive force depending on a variation in length or diameter of a connection pipe, and a constant-speed compressor 1*b* to correspond to a variation in the load of the multi-air conditioner.

The operational control method of a multi-air conditioner according to the present invention has the following advantages.

First, although lengths or diameters of pipes connected to each of the indoor heat exchangers are different, each room can be air-conditioned above a predetermined level.

Second, since the inventive operational control method of a multi-air conditioner sets the prescribed pressure at multi-stages, an abrupt variation in indoor temperature is prevented and application of a sudden large load is also prevented.

Third, in the inventive operational control method of a multi-air conditioner, a variable compressor and a constant-speed compressor are installed to thus prevent the variable from being verloaded.

It will be apparent to those skilled in the art that various modifications and variations can be made in the present invention.

Thus, it is intended that the present invention covers the modifications and variation of this invention provided they come within the scope of the appended claims and their equivalents.

What is claimed is:

1. A method for controlling an operation of a multi-air conditioner, the method comprising the steps of:

compressing refrigerant by a compressor provided in an outdoor unit and discharging the compressed refrigerant;

measuring, in a heating mode or a cooling mode, pressures of the refrigerant flowing in or out a plurality of indoor heat exchangers and the compressor; and compensating the pressures of the refrigerant in the indoor heat exchangers to a prescribed pressure range.

2. The method of claim 1, wherein the step of measuring the pressures of the refrigerant flowing in or out the indoor heat exchangers comprises the step of measuring the pressure of the refrigerant in an inlet of each of the indoor heat exchangers according to the respective operation modes.

3. The method of claim 2, wherein the step of measuring the pressure of the refrigerant in or out the indoor heat exchangers comprises the steps of:

measuring temperatures of refrigerant flowing in or out the indoor heat exchangers; and converting the measured temperatures to pressures stored in a sensor.

4. The method of claim 1, wherein the step of compensating for the pressure comprises the steps of:

comparing any one of the measured pressures of refrigerant flowing in or out the indoor heat exchangers with a prescribed pressure and determining which one is greater than the other; and increasing a compressive force of the compressor according to the result of the comparison.

5. The method of claim 4, wherein the step of comparing pressures comprises the step of comparing the lowest pressure of the refrigerant flowing in or out the indoor heat exchangers with the prescribed pressure.

6. The method of claim 5, wherein the step of increasing the compressive force comprises the step of gradually increasing the compressive force of the compressor in a plurality of multi-stages.

7. The method of claim 4, wherein the step of comparing pressures comprises the step of comparing an average value of the pressures of the refrigerant flowing in or out the indoor heat exchangers with the prescribed pressure.

8. The method of claim 4, wherein the step of increasing the compressive force comprises the step of gradually increasing the compressive force of the compressor in a plurality of multi-stages.

9. The method of claim 4, wherein the step of increasing the compressive force comprises the step of increasing the compressive force by a variable compressor depending on a variation in length or diameter of a connection pipe.

10. The method of claim 9, wherein the step of increasing the compressive force is performed by the variable compressor and a constant-speed compressor.

11. The method of claim 1, wherein the step of compensating the pressures comprises the steps of:

comparing any one of differences between the pressures of the refrigerant flowing in or out the indoor heat exchangers and the pressure of the refrigerant flowing in or out the compressor with the prescribed pressure and determining which one is greater than the other; and increasing a compressive force of the compressor according to the result of the comparison.

12. The method of claim 11, wherein the step of measuring the pressure comprises the steps of:

measuring, in the cooling mode, an inlet refrigerant pressure of each of the indoor heat exchangers and an inlet refrigerant pressure of the compressor considering flow of the refrigerant; and measuring, in the heating mode, an outlet refrigerant pressure of each of the indoor heat exchangers and an outlet refrigerant pressure of the compressor considering flow of the refrigerant.

13. The method of claim 12, wherein the step of comparing the pressures comprises the step of comparing a maximal value of the pressure differences with the prescribed pressure.

14. The method of claim 13, wherein the step of increasing the compressive force comprises the step of gradually increasing the compressive force of the compressor in a plurality of multi-stages.

15. The method of claim 14, wherein the step of increasing the compressive force comprises the step of increasing the compressive force by a variable compressor depending on a variation in length or diameter of a connection pipe.

16. The method of claim 12, wherein the step of comparing the pressures comprises the step of comparing an average value of the pressure differences with the prescribed pressure.

17. The method of claim 11, wherein the step of increasing the compressive force comprises the step of gradually increasing the compressive force of the compressor in a plurality of multi-stages.

18. The method of claim 11, wherein the step of increasing the compressive force comprises the step of increasing the compressive force by a variable compressor depending on a variation in length or diameter of a connection pipe.

19. The method of claim 18, wherein the step of increasing the compressive force is performed by the variable compressor and the constant-speed compressor.

20. The method of claim 19, wherein the step of measuring the pressures of the refrigerant in or out the indoor heat exchangers comprises the steps of:

measuring temperatures of the refrigerant flowing in or out the respective indoor heat exchangers side; and converting the measured temperatures to pressures stored in a sensor.

* * * * *